US011597007B2

(12) United States Patent
Shuto et al.

(10) Patent No.: US 11,597,007 B2
(45) Date of Patent: Mar. 7, 2023

(54) LOW-PRESSURE CASTING DEVICE

(71) Applicant: HONDA MOTOR CO., LTD., Tokyo (JP)

(72) Inventors: Kenichi Shuto, Tochigi-ken (JP); Hiroshi Takahashi, Tokyo (JP); Masayuki Hattori, Tochigi-ken (JP); Tsuginori Usami, Tochigi-ken (JP); Keisuke Kagami, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/612,298

(22) PCT Filed: Apr. 6, 2020

(86) PCT No.: PCT/JP2020/015476
§ 371 (c)(1),
(2) Date: Nov. 18, 2021

(87) PCT Pub. No.: WO2020/235235
PCT Pub. Date: Nov. 26, 2020

(65) Prior Publication Data

US 2022/0226887 A1 Jul. 21, 2022

(30) Foreign Application Priority Data

May 22, 2019 (JP) ..... JP2019-095741

(51) Int. Cl.
*B22D 18/04* (2006.01)

(52) U.S. Cl.
CPC ..... *B22D 18/04* (2013.01)

(58) Field of Classification Search
CPC ..... B22D 18/04
See application file for complete search history.

(56) References Cited

U.S. PATENT DOCUMENTS

2010/0326617 A1 12/2010 Nakama et al.
2011/0253337 A1 10/2011 Matsui et al.

FOREIGN PATENT DOCUMENTS

CN 104668521 6/2015
JP 59-006055 1/1984
(Continued)

OTHER PUBLICATIONS

International Search Report and Written Opinion for International Application No. PCT/JP2020/015476 dated Jun. 23, 2020, 11 pages.
(Continued)

*Primary Examiner* — Kevin P Kerns
*Assistant Examiner* — Steven S Ha
(74) *Attorney, Agent, or Firm* — Amin, Turocy & Watson, LLP

(57) ABSTRACT

Provided is a low-pressure casting device whereby maintenance of an intermediate stoke can be facilitated. The present invention provides a low-pressure casting device having: a crucible inside which molten metal is stored; a stoke body which is inserted in the crucible and which supplies molten metal into a cavity of a die; and an intermediate stoke for connecting a sprue of the die and the stoke body; wherein the intermediate stoke has an inner, an intermediate stoke body for retaining the inner in the inside thereof, and a cover for covering the outside of the intermediate stoke body via a heat insulating part, a heater accommodating groove is formed in a side surface of the intermediate stoke body, and a heater is attached to the heater accommodating groove.

2 Claims, 8 Drawing Sheets

(56) References Cited

FOREIGN PATENT DOCUMENTS

| | | |
|---|---|---|
| JP | 04-047856 | 4/1992 |
| JP | 04-083466 | 7/1992 |
| JP | 04-361850 | 12/1992 |
| JP | 05-104233 | 4/1993 |
| JP | 05-076660 | 10/1993 |
| JP | 3049825 | 6/2000 |
| JP | 2010-017743 | 1/2010 |
| JP | 2010-167495 | 8/2010 |

OTHER PUBLICATIONS

Chinese Office Action and Search Report for Chinese Patent Application No. 202080038039.6 dated Sep. 26, 2022.

24

LOW-PRESSURE CASTING DEVICE

TECHNICAL FIELD

The present invention relates to a low-pressure casting device having an intermediate stalk connecting the sprue of a die and a stalk body.

BACKGROUND ART

JP H05-104233 A discloses a low-pressure casting device. The low-pressure casting device is provided with a heater for heating a flange of a stalk body in order to suppress a decrease in temperature of a furnace lid penetration portion of the stalk body. Further, JP 3049825 B2 discloses a low-pressure casting device in which a heater is built in an intermediate stalk wall surface of an intermediate stalk in order to prevent solidification of molten metal near the intermediate stalk.

SUMMARY OF INVENTION

In the techniques disclosed in JP H05-104233 A and JP 3049825 B2, it is difficult to uniformly heat the intermediate stalk. Therefore, the adhesion of the molten metal to the intermediate stalk may not be sufficiently suppressed. When the molten metal adheres to the intermediate stalk, it is necessary to perform an operation of scraping off the adhered molten metal, and it takes time for maintenance of the intermediate stalk.

The present invention has been made to solve the above problems, and an object of the present invention is to provide a low-pressure casting device capable of facilitating maintenance of an intermediate stalk.

According to an aspect of the present invention, provided is a low-pressure casting device comprising: a crucible in which molten metal is stored; a stalk body inserted into the crucible and configured to supply the molten metal into a cavity of a die; and an intermediate stalk configured to connect a sprue of the die and the stalk body, wherein the intermediate stalk includes: an inner; an intermediate stalk body configured to hold the inner on an inside thereof; and a cover configured to cover an outer side of the intermediate stalk body via a heat insulating portion, a heater housing groove is formed on a side surface of the intermediate stalk body, and a heater is attached to the heater housing groove.

According to the present invention, maintenance of the intermediate stalk can be facilitated.

DESCRIPTION OF THE INVENTION

First Embodiment

Figure 1:
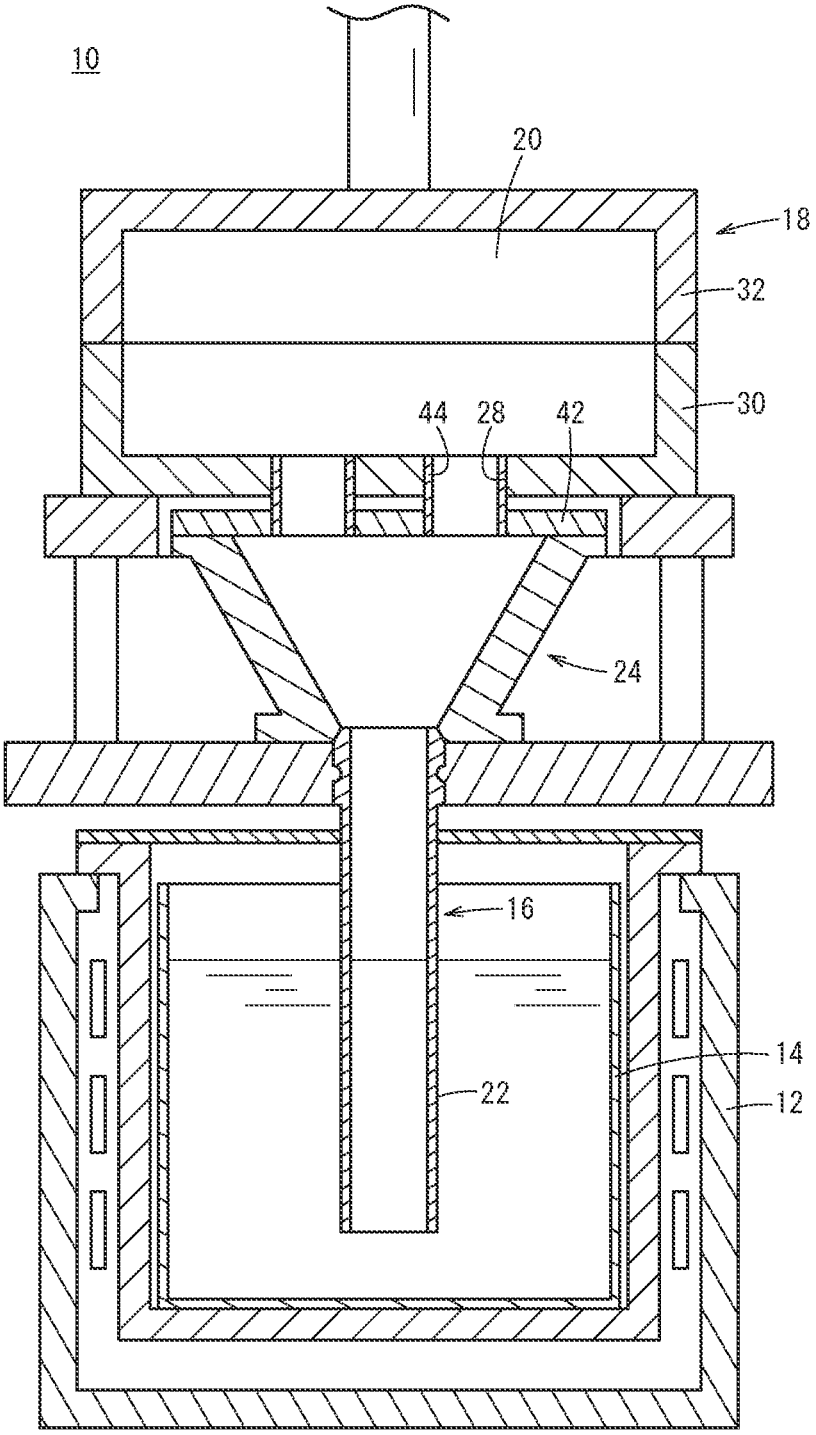
FIG. 1 is a schematic view of a low-pressure casting device.

FIG. 1 is a schematic view of a low-pressure casting device 10. The low-pressure casting device 10 includes a furnace 12, a crucible 14, a stalk 16, and a die 18.

The crucible 14 is installed inside the furnace 12, and the crucible 14 is heated by the furnace 12. Molten metal is stored inside the crucible 14. The molten metal is, for example, a liquid aluminum alloy. The stalk 16 is a member for supplying the molten metal into a cavity 20 of the die 18, and includes a stalk body 22 and an intermediate stalk 24. The lower end portion of the stalk body 22 is inserted into the crucible 14. The upper end portion of the stalk body 22 is connected to the intermediate stalk 24. The intermediate stalk 24 connects the stalk body 22 and sprues 28 of the die 18. The die 18 includes a lower die 30 and an upper die 32. Molten metal is supplied into the cavity 20 partitioned by the lower die 30 and the upper die 32.

The surface of the molten metal in the crucible 14 is applied with pressure by a pressurizing unit (not shown). As a result, the molten metal passes through the stalk body 22 and the intermediate stalk 24 and is supplied into the cavity 20 of the die 18. When the molten metal supplied into the cavity 20 is cooled and solidified, the pressure applied to the surface of the molten metal in the crucible 14 is released, and the liquid molten metal remaining in the intermediate stalk 24 and the stalk body 22 returns to the crucible 14.

Figure 2:
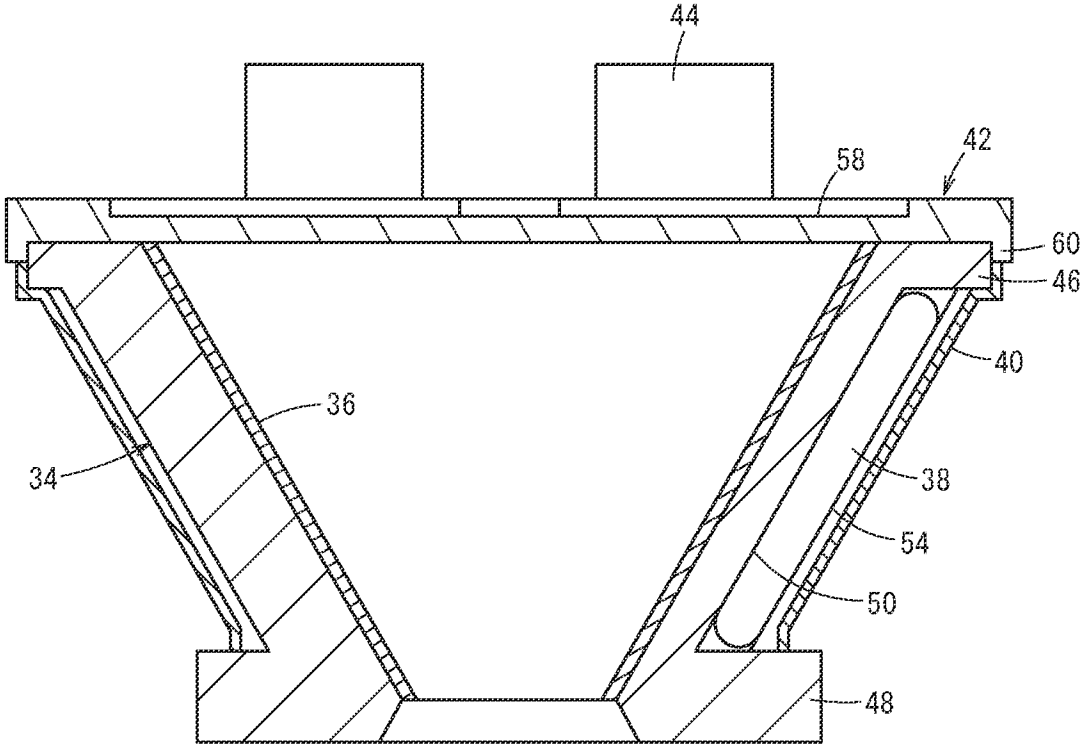
FIG. 2 is a cross-sectional view of an intermediate stalk.

FIG. 2 is a cross-sectional view of the intermediate stalk 24. The intermediate stalk 24 includes an intermediate stalk body 34, an inner 36, a heater 38, a cover 40, a lid 42 and sprue inserts 44.

The intermediate stalk body 34 is made of spheroidal graphite cast iron (FCD). The intermediate stalk body 34 may be formed of another material as long as the material has strength against thermal shock. The inner side surface and the outer side surface of the intermediate stalk body 34 are both formed in a substantially conical shape. An upper flange 46 extending outward in the radial direction is formed on the upper portion of the intermediate stalk body 34, and a lower flange 48 extending outward in the radial direction is formed on the lower portion of the intermediate stalk body 34.

Figure 3:
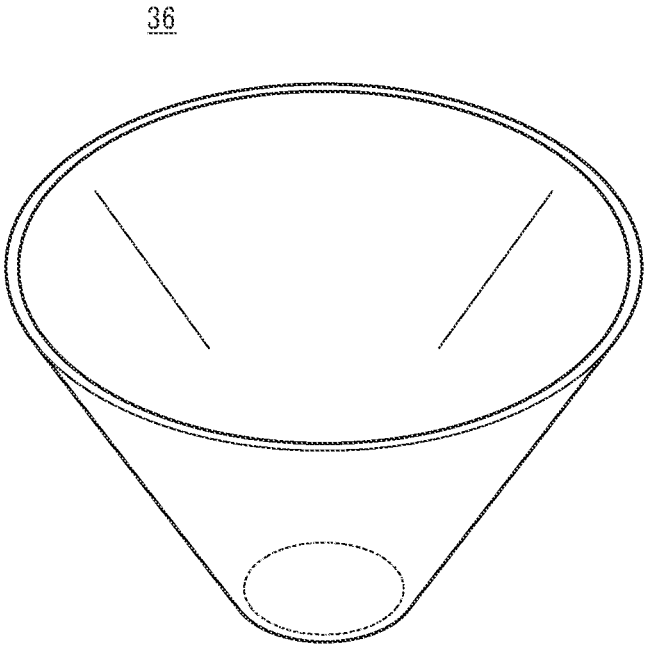
FIG. 3 is a perspective view of an inner.

The inner 36 is installed on the inner side surface of the intermediate stalk body 34. FIG. 3 is a perspective view of the inner 36. The inner 36 is made of silicon carbonate (SiC). The inner 36 may be formed of another material as long as the material has strength against thermal shock. The inner side surface and the outer side surface of the inner 36 are both formed in a substantially conical shape.

Figure 4:
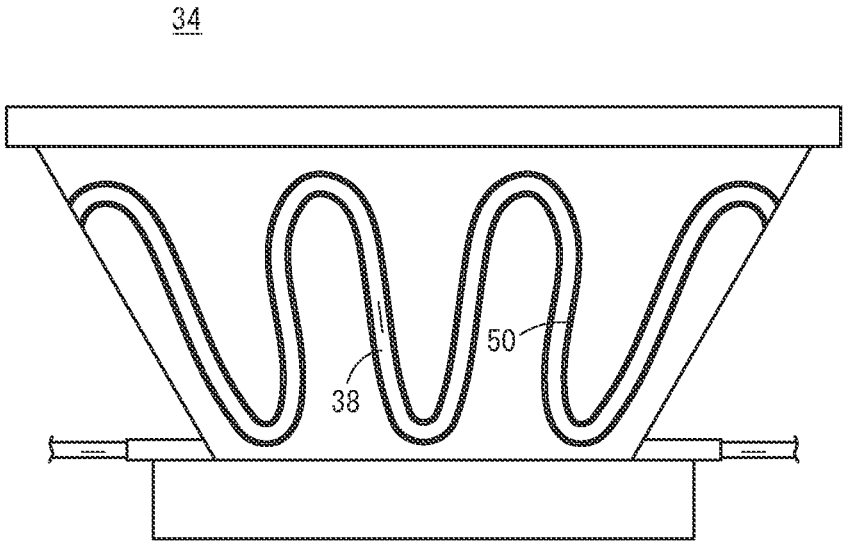
FIG. 4 is a side view of an intermediate stalk body.

FIG. 4 is a side view of the intermediate stalk body 34. Three heater housing grooves 50 are formed on the outer side surface of the intermediate stalk body 34 so as to meander in the height direction of the intermediate stalk body 34. The heater 38 is housed in each of the heater housing grooves 50. That is, three heaters 38 are attached to the intermediate stalk body 34.

Figure 5:
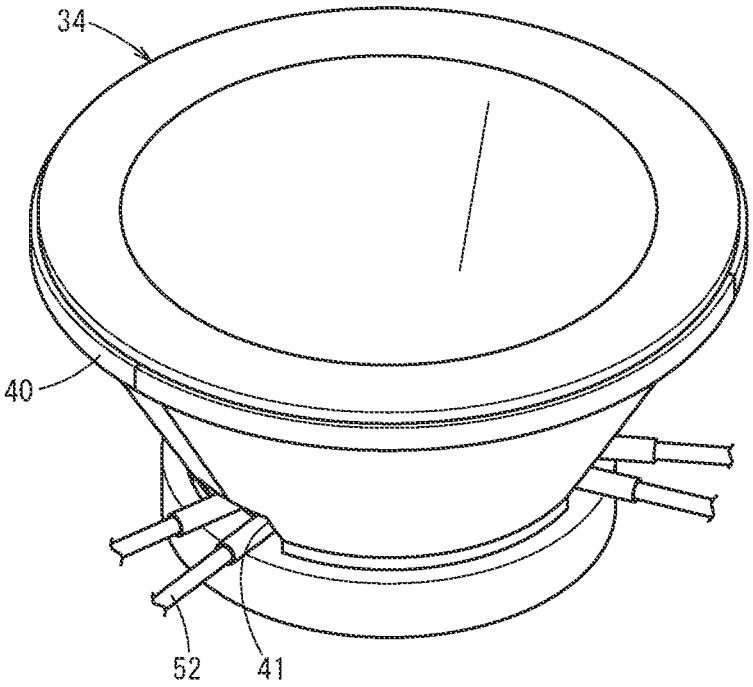
FIG. 5 is a perspective view showing a state in which a cover is attached to the intermediate stalk body.
Figure 6:
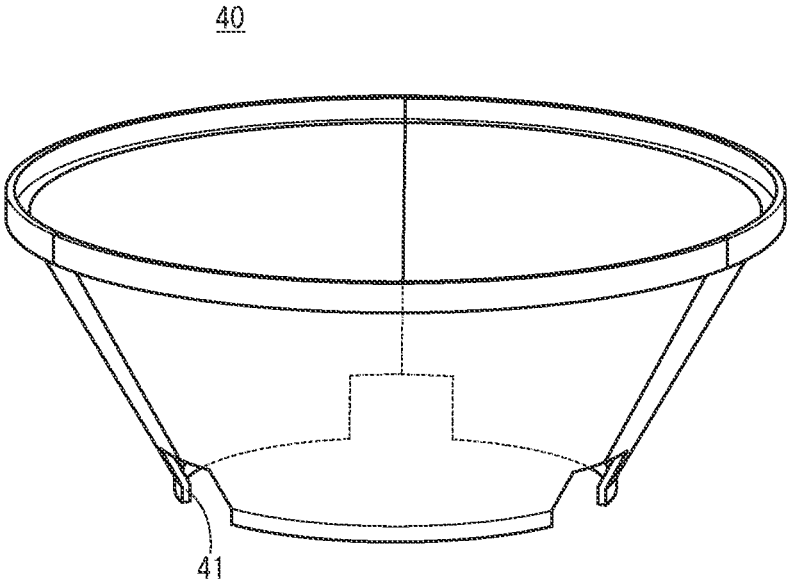
FIG. 6 is a perspective view of the cover.

FIG. 5 is a perspective view showing a state in which the cover 40 is attached to the intermediate stalk body 34. FIG. 6 is a perspective view of the cover 40. The cover 40 is made of an iron-based metal. The inner side surface and the outer side surface of the cover 40 are both formed in a substantially conical shape. The cover 40 can be divided into three parts, and one of the divided members thereof covers one heater 38. An electric wire 52 of the heater 38 is provided so as to extend to the outside from a cutout portion 41 formed on the lower portion of the cover 40 in a state in which the cover 40 is attached to the intermediate stalk body 34. Each of the divided members of the cover 40 is individually detachably locked to the intermediate stalk body 34. By removing one of the divided members of the cover 40 from the intermediate stalk body 34, one heater 38 is exposed to the outside. This facilitates replacement of the heater 38.

As shown in FIG. 2, the lower end portion of the cover 40 is positioned by the lower flange 48 of the intermediate stalk body 34. The upper end portion of the cover 40 is locked to the outer periphery of the upper flange 46 of the intermediate stalk body 34, and is positioned by a locking portion 60, which will be described later, of the lid 42. With the cover 40 attached to the intermediate stalk body 34, a space is provided between the heater 38 and the cover 40. This space allows air to flow therethrough, and constitutes a heat insulating portion 54.

Figure 7:
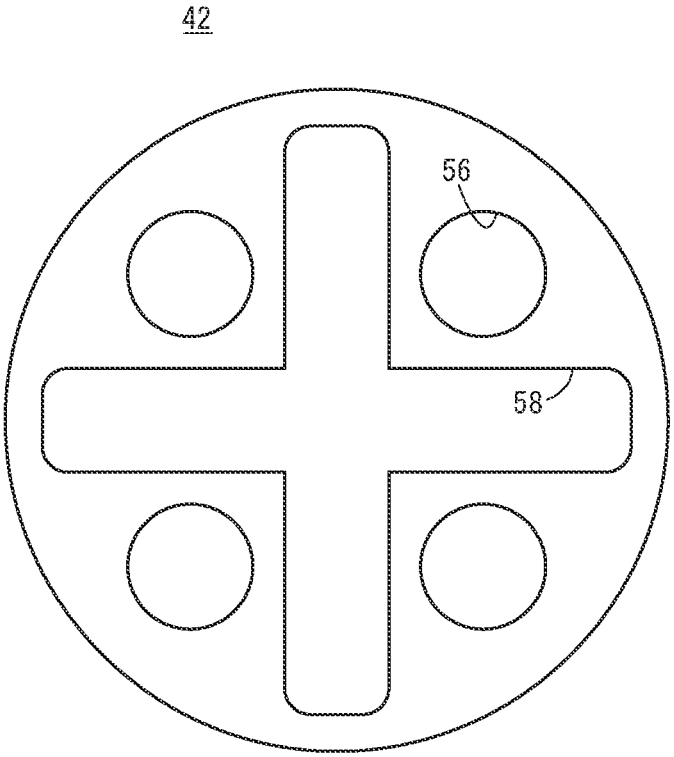
FIG. 7 is a top view of a lid.
Figure 8:
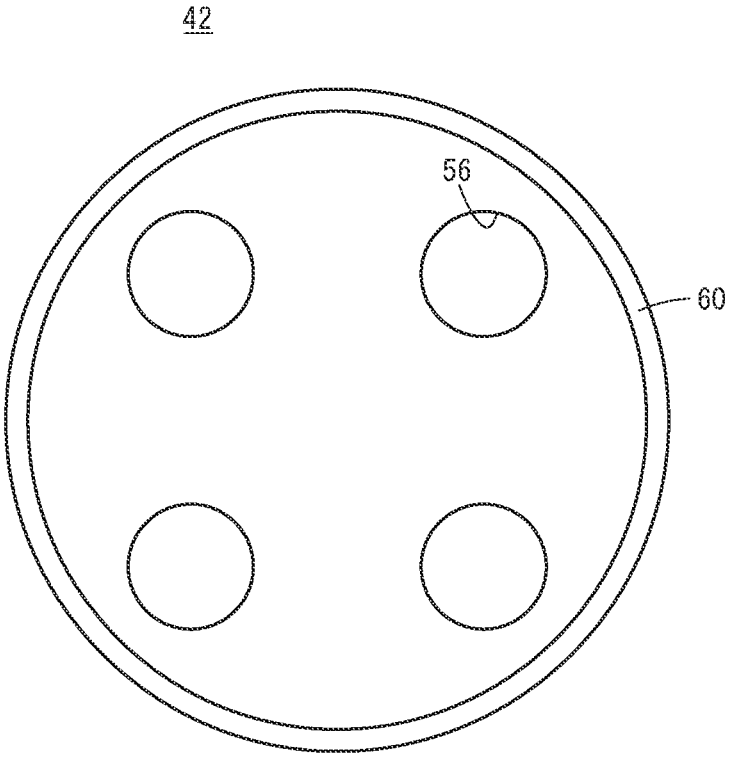
FIG. 8 is a bottom view of the lid.

FIG. 7 is a top view of the lid 42. FIG. 8 is a bottom view of the lid 42. The lid 42 is made of spheroidal graphite cast iron (FCD). The lid 42 may be formed of another material as long as the material has strength against thermal shock. The lid 42 is formed in a disk shape, and includes four through holes 56 penetrating in the thickness direction of the disk. The sprue insert 44 to be inserted into the sprue 28 of the die 18 is inserted into each of the through holes 56 (FIG. 1). A recess 58 is formed in the upper surface of the lid 42. Foreign matter such as moisture is stored in the recess 58. Thus, entry of foreign matter from the through hole 56 into the intermediate stalk body 34 is suppressed. The lower surface of the lid 42 has an outer peripheral edge slightly protruding from the lower surface to form the locking portion 60. The lid 42 is attached to the intermediate stalk 24 with the locking portion 60 thereof locked to the outer periphery of the upper flange 46 of the intermediate stalk body 34.

Effects

In the low-pressure casting device 10, as described above, pressure is applied to the surface of the molten metal in the crucible 14. The molten metal passes through the stalk body 22 and the intermediate stalk 24 and is supplied into the cavity 20 of the die 18. When the molten metal supplied into the cavity 20 is cooled and solidified, the pressure applied to the surface of the molten metal in the crucible 14 is released, and the liquid molten metal remaining in the intermediate stalk 24 and the stalk body 22 returns to the crucible 14.

The temperature of the intermediate stalk 24 tends to be lower than that of the stalk body 22 inserted into the crucible 14. Therefore, the molten metal may be cooled and solidified in the intermediate stalk 24, and deposits may remain in the intermediate stalk 24. As the volume of the deposits in the intermediate stalk 24 increases, the area of a runner extending from the stalk body 22 toward the cavity 20 of the die 18 decreases. This may prevent a sufficient amount of molten metal from being fed into the cavity 20. As a result, it is necessary to perform an operation such as scraping off the deposits in the intermediate stalk 24, and it takes time for maintenance. Thus, there is a problem that the time for stopping the casting becomes long and the efficiency of product production deteriorates.

Therefore, in the low-pressure casting device 10 of the present embodiment, the inner 36 is held inside the intermediate stalk body 34. Thus, even if the molten metal is cooled and solidified and adheres to the inside of the intermediate stalk 24, the deposits thereof in the intermediate stalk 24 can be removed only by replacing the inner 36. Therefore, the time required for maintenance can be shortened, and the efficiency of product production can be improved.

Further, in the low-pressure casting device 10 of the present embodiment, the heater 38 is attached to the heater housing groove 50 formed in the outer side surface of the intermediate stalk body 34. Thus, the heater 38 can be disposed at a position close to the inner side surface of the intermediate stalk body 34, and the molten metal in the intermediate stalk 24 can be efficiently heated. Therefore, cooling and solidification of the molten metal in the intermediate stalk 24 can be suppressed, and the amount of deposits can be reduced.

Further, in the low-pressure casting device 10 of the present embodiment, the heater housing groove 50 is formed so as to meander in the height direction of the intermediate stalk body 34. Thus, the heater 38 is also attached so as to meander in the height direction of the intermediate stalk body 34. Therefore, the molten metal in the intermediate stalk body 34 can be uniformly heated. Further, since the heater 38 is attached to the outer side surface of the intermediate stalk body 34, the heater 38 can be easily replaced.

Moreover, in the low-pressure casting device 10 of the present embodiment, the cover 40 can be divided into three parts and is detachably locked to the intermediate stalk body 34. Thus, the heater 38 can be easily replaced.

Technical Idea Obtained from Embodiment

There is provided a low-pressure casting device (10) comprising: a crucible (14) in which molten metal is stored; a stalk body (22) inserted into the crucible and configured to supply the molten metal into a cavity (20) of a die (18); and an intermediate stalk (24) configured to connect a sprue (28) of the die and the stalk body, wherein the intermediate stalk includes: an inner (36); an intermediate stalk body (34) configured to hold the inner on an inside thereof; and a cover (40) configured to cover an outer side of the intermediate stalk body via a heat insulating portion (54), a heater housing groove (50) is formed on a side surface of the intermediate stalk body, and a heater (38) is attached to the heater housing groove. Thus, the time required for maintenance can be shortened, and the efficiency of product production can be improved.

In the above-described low-pressure casting device, the heater housing groove may be formed on the side surface of the intermediate stalk body so as to meander in a height direction of the intermediate stalk body, and the heater may be disposed along the heater housing groove. Thus, cooling and solidification of the molten metal in the intermediate stalk can be suppressed, and the amount of deposits can be reduced.

In the above-described low-pressure casting device, the cover may be divided into at least two parts, and may be detachably attached to the intermediate stalk body. Thus, the heater can be easily replaced.

In the above-described low-pressure casting device, the heater housing groove may be formed on an outer side surface of the stalk body. Thus, the heater can be easily replaced.

REFERENCE SIGNS LIST

10: low-pressure casting device
14: crucible
18: die
20: cavity
22: stalk body
24: intermediate stalk
34: intermediate stalk body
36: inner
38: heater
40: cover

50: heater housing groove
54: heat insulating portion

What is claim is:

1. A low-pressure casting device comprising:

a crucible in which molten metal is stored;

a stalk body inserted into the crucible and configured to supply the molten metal into a cavity of a die; and an intermediate stalk configured to connect a sprue of the die and the stalk body, wherein the intermediate stalk has a substantially conical shape and includes:

an inner;

an intermediate stalk body configured to hold the inner on an inside thereof; and a cover configured to cover an outer side of the intermediate stalk body via a heat insulating portion, a heater housing groove is formed on a side surface of the intermediate stalk body, and a heater is attached to the heater housing groove, the heat insulating portion is a space that is provided between the heater and the cover in a state in which the cover is attached to the intermediate stalk body, the heater housing groove is formed on an outer side surface of the intermediate stalk body so as to meander in a height direction of the intermediate stalk body, and the heater is disposed along the heater housing groove.

2. The low-pressure casting device according to claim 1, wherein the cover is divided into at least two parts, and is detachably attached to the intermediate stalk body.

* * * * *